US006988337B1

(12) United States Patent
Heierli

(10) Patent No.: US 6,988,337 B1
(45) **Date of Patent: *Jan. 24, 2006**

(54) MEANS AND METHOD FOR CONSTRUCTING A FULLY PRECAST TOP ARCH OVERFILLED SYSTEM

(75) Inventor: Werner Heierli, Zurich (CH)

(73) Assignee: BEBOTech Corporation, Middletown, OH (US)

( * ) Notice: Subject to any disclaimer, the term of this patent is extended or adjusted under 35 U.S.C. 154(b) by 11 days.

This patent is subject to a terminal disclaimer.

(21) Appl. No.: 10/338,906

(22) Filed: Jan. 9, 2003

Related U.S. Application Data

(63) Continuation-in-part of application No. 10/102,921, filed on Mar. 22, 2002, now Pat. No. 6,719,492.

(51) Int. Cl.
*E04B 1/32* (2006.01)

(52) U.S. Cl. ..... 52/86; 405/134; 405/151; 52/88; 52/89

(58) Field of Classification Search ..... 52/87, 52/86, 263, 88, 89, 169.9, 294, 299, 295, 52/604, 586.1; 405/125, 124, 134, 135, 151, 405/150.1, 287.1, 146, 153; 14/24, 69.5, 14/25, 26; 403/292, 293, 296
See application file for complete search history.

(56) References Cited

U.S. PATENT DOCUMENTS

| | | | | |
|---|---|---|---|---|
| 3,482,406 A | | 12/1969 | Schuppisser et al. | |
| 3,750,407 A | | 8/1973 | Heierli et al. | |
| 3,999,394 A | | 12/1976 | Eberhardt et al. | |
| 4,221,502 A | | 9/1980 | Tanikawa | |
| 4,300,320 A | | 11/1981 | Rooney | |
| 4,458,457 A | | 7/1984 | Heierli | |
| 4,490,950 A | | 1/1985 | Heierli | |
| 4,537,529 A | | 8/1985 | FitzSimmons | |
| 4,558,969 A | | 12/1985 | FitzSimmons | |
| 4,587,684 A | | 5/1986 | Miller | |
| 4,595,314 A | | 6/1986 | Lockwood | |
| 4,687,371 A | | 8/1987 | Lockwood | |
| 4,695,187 A | | 9/1987 | Mikhailovsky et al. | |
| 4,704,754 A | | 11/1987 | Bonasso | |
| 4,745,713 A | | 5/1988 | Gotoh | |
| 4,797,030 A | | 1/1989 | Lockwood | |
| 4,854,775 A | | 8/1989 | Lockwood | |
| 4,993,872 A | | 2/1991 | Lockwood | |
| 5,281,053 A | | 1/1994 | Matiere | |
| 5,439,319 A | * | 8/1995 | Flanagan et al. | 405/152 |
| 5,836,717 A | | 11/1998 | Bernini | |
| D406,902 S | | 3/1999 | Lockwood | |
| 6,161,342 A | | 12/2000 | Barbier et al. | |
| 6,243,994 B1 | | 6/2001 | Bernini | |
| 6,434,892 B1 | | 8/2002 | Heierli | |
| 6,460,213 B1 | | 10/2002 | Flint et al. | |
| 6,719,492 B1 | * | 4/2004 | Heierli | 405/124 |

FOREIGN PATENT DOCUMENTS

AT 395894 B 3/1993

(Continued)

*Primary Examiner*—Carl D. Friedman
*Assistant Examiner*—Chi Q. Nguyen
(74) *Attorney, Agent, or Firm*—Thompson Hine LLP

(57) ABSTRACT

The top arch overfilled system defined in application Ser. No. 10/102,921 is formed of precast arch elements which are formed and shipped in a use orientation. The precast arch elements can include arch footings and the system can include a plurality of precast arch elements which can be tied together. The arch elements can also be prestressed.

27 Claims, 8 Drawing Sheets

FOREIGN PATENT DOCUMENTS

| | | | |
|---|---|---|---|
| EP | 0393197 | A | 10/1990 |
| JP | 07003826 | A | 6/1995 |
| NL | AT 397981 | B | 8/1994 |
| NL | 9300550 | A | 10/1994 |

* cited by examiner

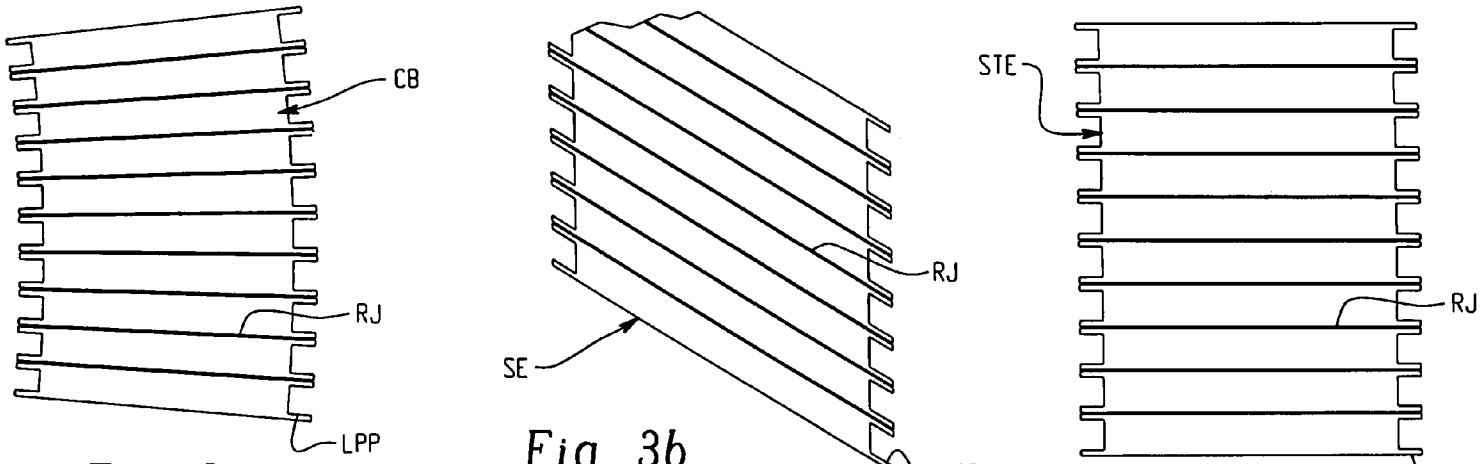
Fig. 3a
Fig. 3b
Fig. 3c
PRIOR ART
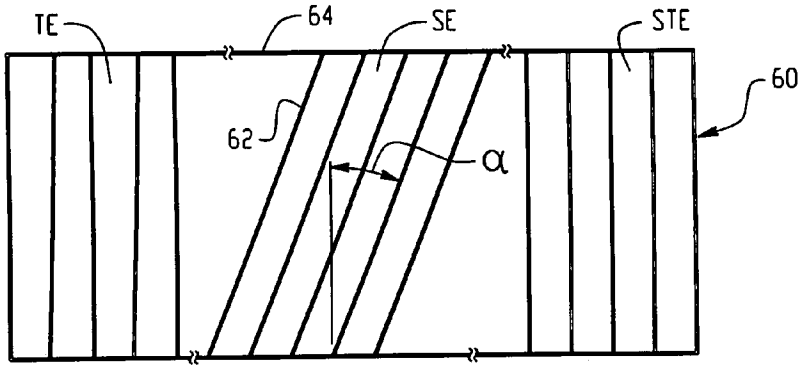
Fig. 4
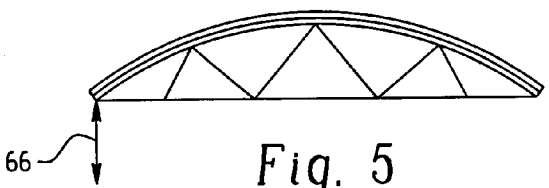
Fig. 5

MEANS AND METHOD FOR CONSTRUCTING A FULLY PRECAST TOP ARCH OVERFILLED SYSTEM

CROSS-REFERENCE TO RELATED APPLICATIONS

The present application is a continuation-in-part application of Ser. No. 10/102,921 filed by the same inventor on Mar. 22, 2002 now U.S. Pat. No. 6,719,492, and assigned to the same assignee. The disclosure of the 10/102,921 document is fully incorporated herein by reference. This application also claims priority based on Ser. No. 10/131,526 filed on Apr. 25, 2002, and the disclosure of the application Ser. No. 10/131,526 is also fully incorporated herein by reference.

TECHNICAL FIELD OF THE INVENTION

The present invention relates to the general art of structural, bridge and geotechnical engineering, and to the particular field of overfilled arch and/or cut-and-cover structures.

BACKGROUND OF THE INVENTION

As discussed in the incorporated document, overfilled arch structures are frequently formed of precast or cast-in-place reinforced concrete and are used in the case of bridges to support one pathway over a second pathway, which can be a waterway, a traffic route, or in the case of other structures, a storage space or the like. The terms "overfilled arch" or "overfilled bridge" will be understood from the teaching of the present disclosure, and in general as used herein, an overfilled bridge or an overfilled arch is a bridge formed of arch elements that rest on the ground or on a foundation and has soil or the like resting thereon and thereabout to support and stabilize the structure and in the case of a bridge provide the surface of the first pathway. The arch form is generally arcuate such as cylindrical in circumferential shape, and in particular a prolate shape; however, other shapes can be used. Examples of overfilled bridges are disclosed in U.S. Pat. Nos. 3,482,406 and 4,458,457, the disclosures of which are incorporated herein by reference.

Prior to the structure disclosed in the incorporated 102,921 document, reinforced concrete overfilled arches were usually constructed by either casting the arch in place or placing precast elements, or a combination of these. As used herein, the term "prior art" will refer to structures prior to the structure disclosed in the incorporated 102,921 document. These arched structures rest on prepared foundations at the bottom of both sides of the arch. The fill material, at the sides of the arch (backfill material) serves to diminish the outward displacements of the structure when the structure is loaded from above. As used herein, the term "soil" is intended to refer to the normal soil, which can be backfill or in situ, located at a site used for a bridge structure, and which would not necessarily otherwise adequately support an arch. The terms "backfill," and "in situ" will be used to mean such "soil" as well.

Soil is usually not mechanically stiff enough to adequately support bridge structures of interest to this invention. Thus, prior art bridge structures have been constructed to transfer forces associated with the structure to walls of the structure and/or large concrete foundations at the base of the wall. Such walls have to be constructed in a manner that will support such forces and thus have special construction requirements. As will be discussed below, such requirements present drawbacks and disadvantages to such prior art structures.

As discussed in the incorporated 102,921 document, for the prior art structures, the overfilled arches are normally formed such that the foundation level of the arch is at the approximate level of a lower pathway or floor surface of an underground structure over which the arch spans. As discussed in the incorporated document, prior art systems include sides or sidewalls which transfer loads from the top of the arch to foundation. The sides of such prior art arch systems must be sufficiently thick and contain sufficient reinforcement in order to be able to carry these loads and the thereby induced bending moments.

Furthermore, as it is necessary to limit the arch loading and bending actions in the top and sides of prior art overfilled arch systems to an acceptable level, the radius of the arch is in practice restricted. This restriction in arch radius leads to a higher "rise" (vertical dimension between the top of the clearance profile of lower pathway surface and the crown of the arch) in the arch profile than is often desirable for the economical and practical arrangement of the two pathways and formation of the works surrounding and covering the arch. This results in a lost height which can be substantial in some cases.

Beams or slabs, while needing a larger thickness than arches, do not require this "rise" and, therefore, can be used for bridges accommodating a smaller height between the top of the clearance profile of the lower pathway and the top of the upper pathway. Arches, despite their economical advantage, often cannot compete with structures using beams or slabs for this reason especially for larger spans. However, the larger thickness may result in an expensive structure whose precast elements may be difficult, unwieldy and heavy to transport to a building site. Thus, many of the advantages of beam or slab structures may be offset or vitiated.

Furthermore, as discussed in the incorporated document, the foundations for the prior art overfilled arch systems must be substantial in order to carry the arch loading and will require additional excavation at the base of the arch (generally beneath the lower pathway) to enable their construction.

For overfilled arches made of precast construction, the incorporation of the required height of the sides or sidewalls of the arch result either in a tall-standing precast element which is difficult and unwieldy to transport and to place or in the requirement of pedestals.

The system disclosed in the incorporated document solves these problems by having foundation blocks located behind or near the top of the side walls and against which the arch of the structure bears. The arch delivers all or at least most of its support forces into the foundation blocks.

This is an extremely effective system and accomplishes all of the objects set forth for this system in the incorporated document.

However, the effectiveness of this structure can be further enhanced by improving the methods used to erect the structure. Therefore, there is a need for a means and a method for building the structure disclosed in the incorporated document Ser. No. 10/102,921.

While the cast-in-place (cip) mode of constructing an arch system is suitable for many situations due to its economy and speed, there are certain commercial and technical (site) conditions for which a totally precast structure is preferred. Some of these conditions are:

time restrictions for on-site installation;

weather conditions, especially low temperatures;

the absence of shuttering and crew suited/trained for the cip construction procedure;

a need to limit the specialist contractors' duties to supplying (and, perhaps mounting) precast elements, in contrast to providing total contractor's services (and responsibility);

limited clear space, not allowing allowint the use of a shuttering (such as with live train lines at the lower pathway);

special requirements (aesthetic, etc.).

Therefore, there is a need for a means and a method for building a fully precast overfilled shallow arch structure such as disclosed in the incorporated document.

The precast arch elements in many prior systems are cast on their sides. This requires forms which have walls and also may require special handling of the forms to ensure proper formation of the arch elements. Still further, these elements are generally shipped in the side-on orientation. The elements are then lifted off the transporting vehicle, turned in the air to be oriented in the use orientation (as used herein, the use orientation is an orientation shown in FIG. 1 herein as well as in FIGS. 2A–2C of the incorporated document, and a side-on orientation will have the elements rotated 90° with respect to the orientation shown in these same figures). Side-on formation and shipping has several drawbacks: complicated formwork; special transportation problems; and lifting problems associated with lifting and turning such elements.

Therefore, there is a need for a means and a method for forming and shipping a precast arch element such as disclosed in the incorporated document in a use orientation.

In the case of relatively large overfills, no connection may be required between adjacent arch elements because the overfilled soil spreads the loads on the overfill surface so that no differential displacements between adjacent elements occur. Differential displacements are caused by loads, such as traffic loads, placed only on one arch element, then on the adjacent arch element, and so on. Such deformations may lead to so called deflection cracking (cracks that propagate from the top of the arch element to the pavement surface). Such deformations should be avoided.

For shallow arch applications, shallow overfills are more frequent than high overfills since the shallow arch is preferably used where lost height needs to be minimized. In such a case, with only one or two feet or even only inches of overfill or almost-zero overfill in some situations, the live loads may act on individual elements before being transferred to the next one causing the relative vertical displacements that can be such that the pavement of the system will be cracked due to these relative displacements.

Therefore, there is a need for a means and a method for forming an arch system such as disclosed in the incorporated document in a manner that avoids differential displacements between adjacent arch elements of the system.

Still further, there is a need for a means and a method for forming an arch system such as disclosed in the incorporated document in a manner that avoids differential displacements between adjacent arch elements of the system even in the situation of a shallow, or even a zero, overfill.

OBJECTS OF THE INVENTION

It is a main object of the present invention to provide a means and a method for building the structure disclosed in the incorporated document application Ser. No. 10/102,921.

It is another object of the present invention to provide a means and a method for building a fully precast overfilled shallow arch structure such as disclosed in the incorporated document.

It is another object of the present invention to provide a means and a method for forming, stacking and shipping a precast arch element such as disclosed in the incorporated document in a use orientation.

It is another object of the present invention to provide a means and a method for forming an arch system such as disclosed in the incorporated document in a manner that avoids differential displacements between adjacent arch elements of the system.

It is another object of the present invention to provide a means and method for forming an arch system such as disclosed in the incorporated document in a manner that avoids differential displacements between adjacent arch elements of the system even in the situation of a shallow, or even a zero, overfill.

SUMMARY OF THE INVENTION

These, and other, objects are achieved by a means and method for forming an arch system such as disclosed in the incorporated document in which the arch elements are fully precast in a use orientation, then stacked and shipped in a use orientation. It is noted that the term "fully precast" is used herein to mean that the arch element is fully precast and with the exception of some cast-in-place concrete in the footings and in some cases cast-in-place concrete in the crown joints. The arch elements are placed on the foundation blocks in a manner which distributes forces associated with the arch elements to the foundation blocks, as taught in the disclosure of the incorporated document.

The formwork is very simple and no counter forms are usually required. Furthermore, there is no need to turn the elements in the air while hanging from a crane.

The arch elements can be prestressed by pre-deformation either during movement from the shipping vehicle to the in place location, or in another manner. The prestressing will partly or wholly compensate for the influence of possible outward yield (deformation) of the abutments (foundation blocks). The elements are placed in their pre-deformed shape and come back to their intended and optimal shape when overfilled.

The width of arch elements may be limited by the geometric transportation limitations and the weight. The lying down or use orientation has several advantages over the standing way or the side on orientation including the advantages associated with longer elements. For the shallow arches of the present invention, longer elements can be transported (even with footings attached) than with other arch geometries.

It is noted that the means and method disclosed herein can be applied to skew arch structures as well as to spans which do not allow one element solutions but which require a crown joint to connect two halves together. Therefore, spans can range from about twelve feet to eighty-four feet or more.

BRIEF DESCRIPTION OF THE DRAWING FIGURES

FIG. 1 is an elevational view of a completed arch structure as disclosed in the incorporated document and which is formed in accordance with the teaching of the present disclosure.

FIG. 2*a* is a plan view of a system with skew alignment that can be formed in accordance with the teaching of the present disclosure.

FIG. 2*b* is a plan view of a system with curved alignment which can be formed in accordance with the teaching of the present disclosure.

FIG. 2*c* is a plan view of a system with an irregular alignment which can be formed in accordance with the teaching of the present disclosure.

FIG. 3*a* is a plan view of a curved system which can be formed in accordance with the teaching of the present disclosure showing adjacent arch elements.

FIG. 3*b* is a plan view of a skewed system which can be formed in accordance with the teaching of the present disclosure showing adjacent arch elements.

FIG. 3*c* is a plan view of a conventional span system which can be formed in accordance with the teaching of the present disclosure showing adjacent arch elements.

FIG. 4 is a plan view of a form used to form arch elements in a use orientation in accordance with the teaching of the present disclosure.

FIG. 5 is an end elevational view of the form shown in FIG. 4.

Figure 6A:
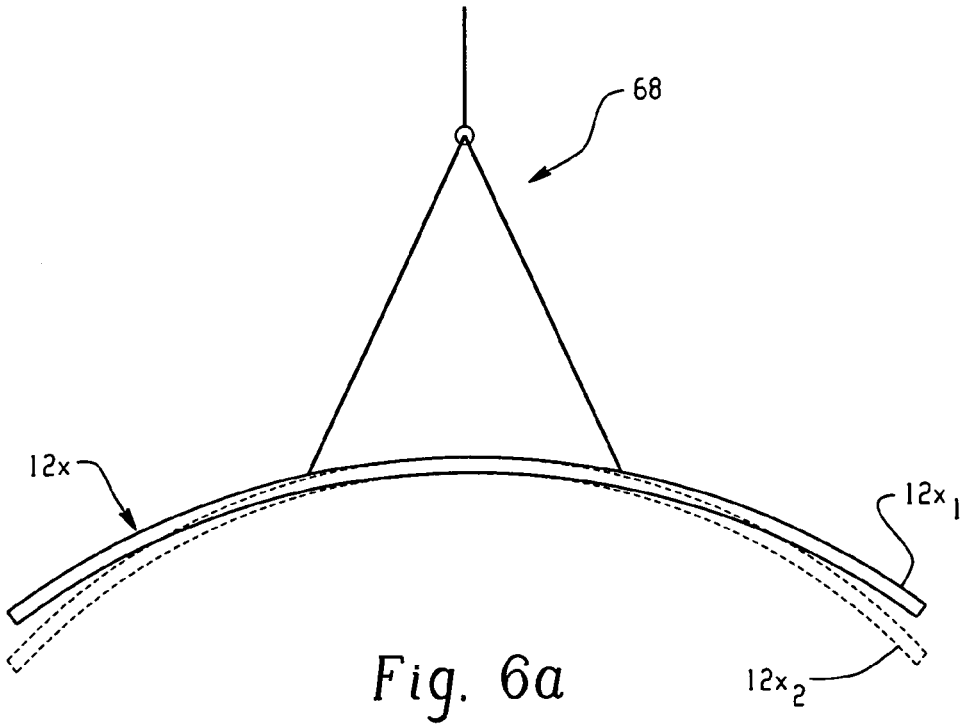

FIG. 6*a* shows an arch element that has been formed in the use orientation being moved in the use orientation.

Figure 6B:
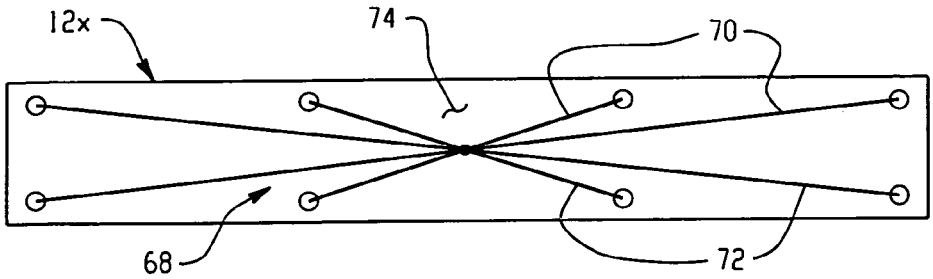

FIG. 6*b* shows a top plan view of the arch element being moved in the use orientation.

Figure 7:
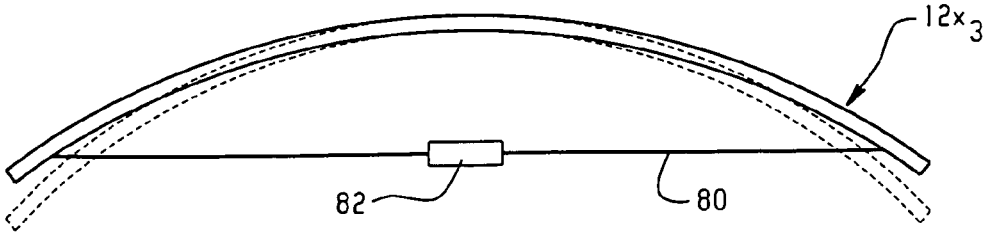

FIG. 7 shows an arch element having a prestressing element associated therewith.

Figure 8:
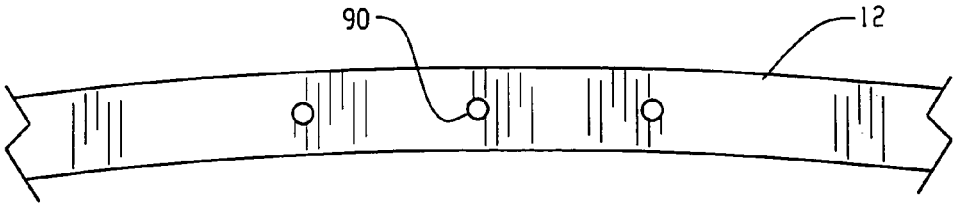

FIG. 8 shows a portion of an arch element in which bores are defined to accommodate tie elements, such as dowel rods or the like.

Figure 9:
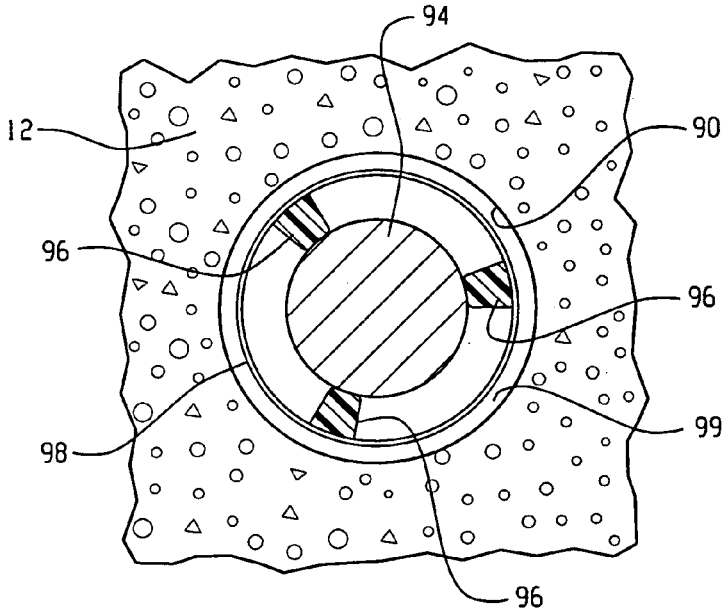
Figure 9A:
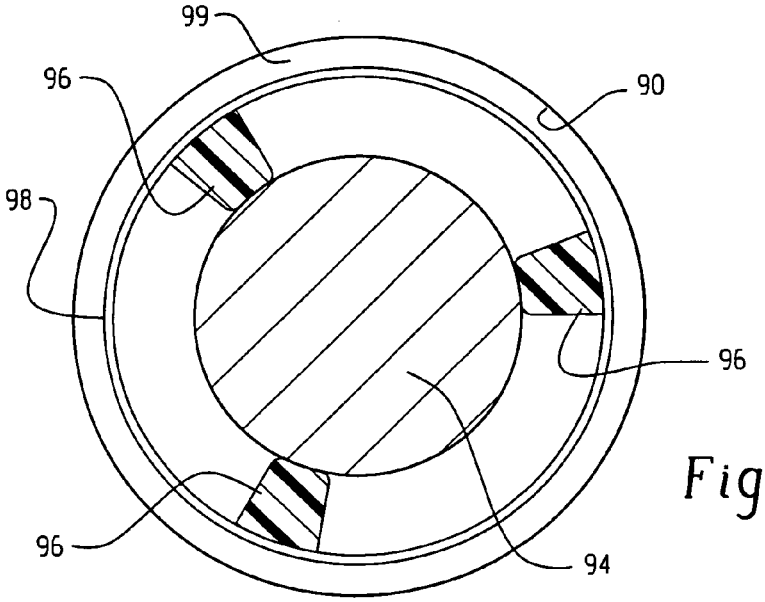

FIGS. 9 and 9*a* show a tie element located in a bore of the arch element.

Figure 10:
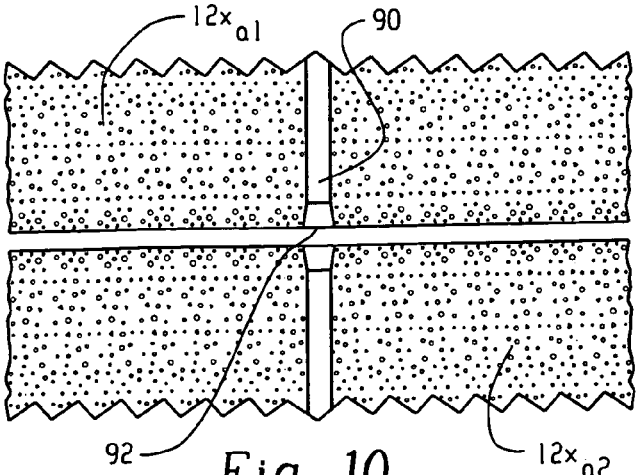

FIG. 10 is a longitudinal section of a plurality of adjacent arch elements.

Figure 11:
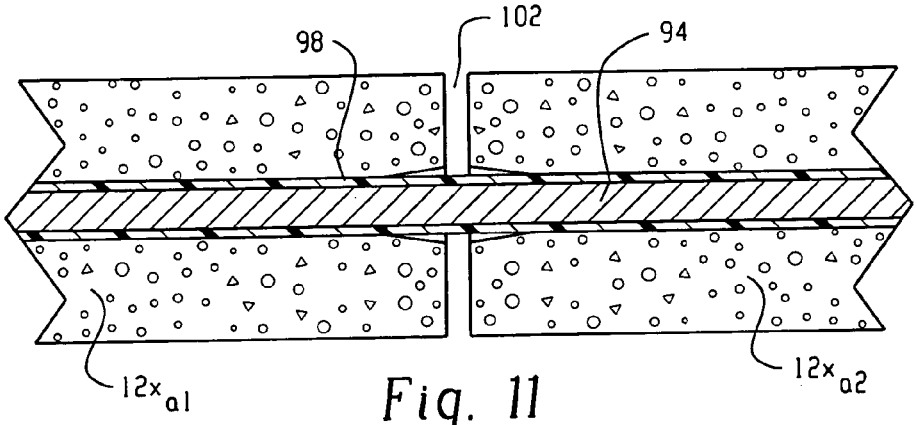

FIG. 11 shows a detail of a connection between adjacent arch elements.

Figure 12:
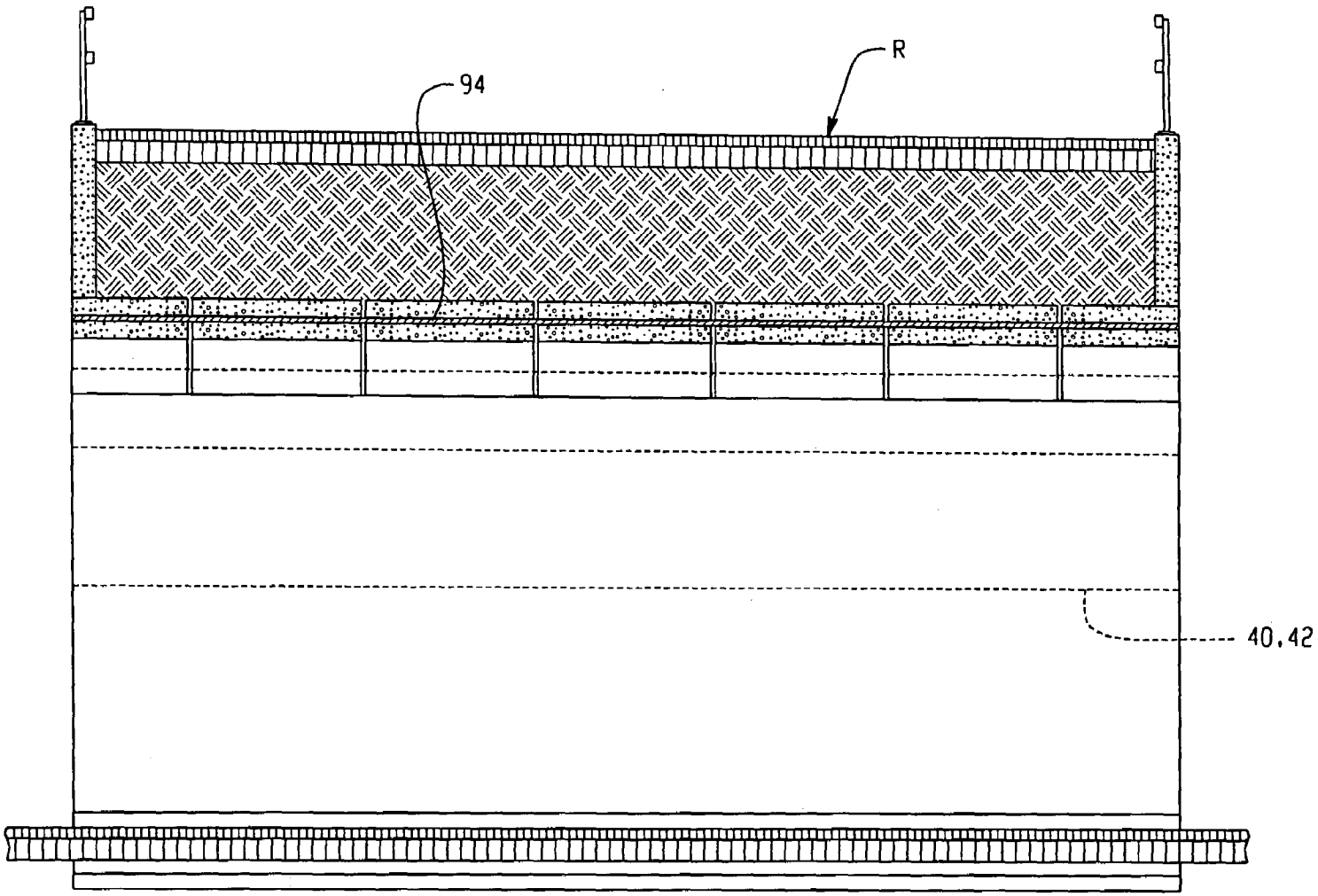

FIG. 12 is an elevational view in section of a completed arch system in which adjacent arch elements are connected together in accordance with the teaching of the present disclosure.

Figure 13:
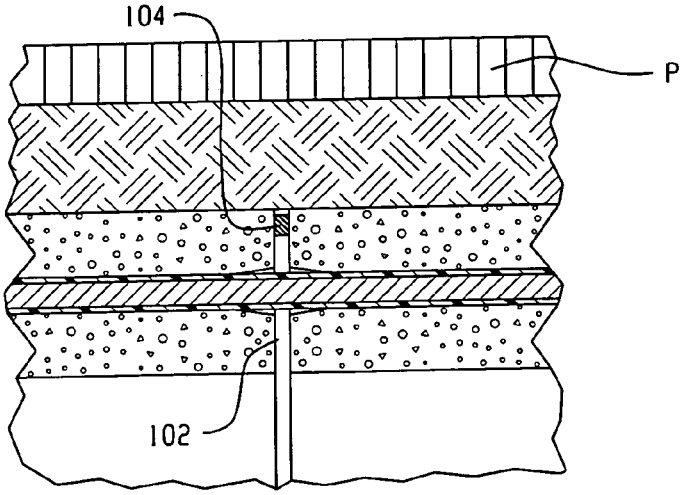

FIG. 13 is a detail view showing a connection between two adjacent arch elements of a completed arch system in accordance with the teaching of the present disclosure.

Figure 14:
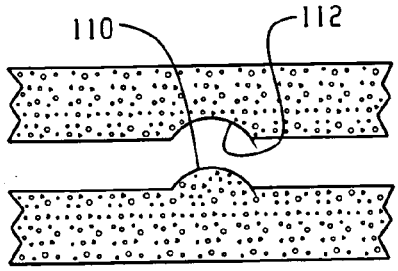

FIG. 14 is a detail view showing an alternative form of a connection between two adjacent arch elements in accordance with the teaching of the present disclosure.

Figure 15:
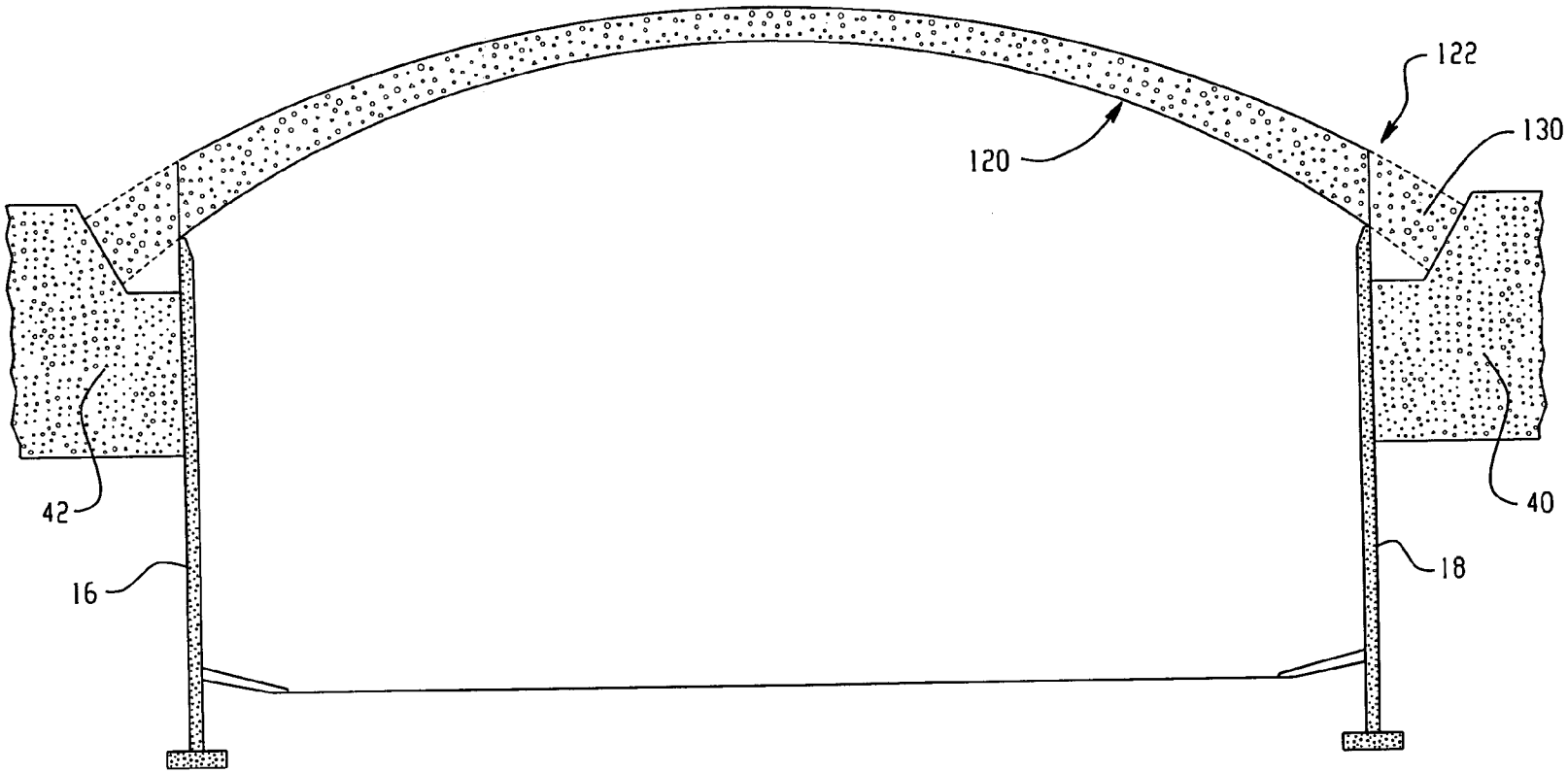

FIG. 15 is an elevational view in section of an arch system showing the arch system during one step in the process of erecting the system in accordance with the teaching of the present disclosure.

Figure 16:
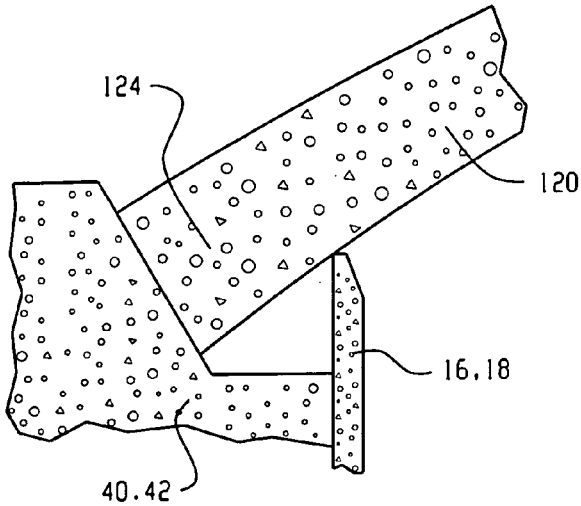

FIG. 16 is a detail view of an end of an arch element and a portion of a foundation block during one step in the process of erecting the arch system in accordance with the teaching of the present disclosure.

Figure 17:
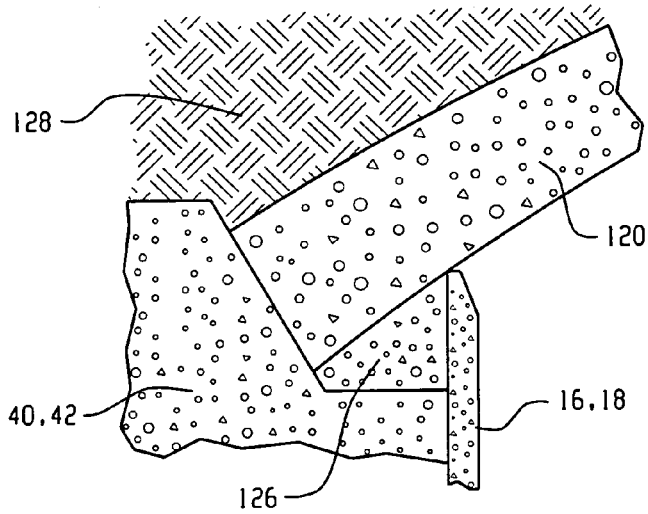

FIG. 17 is a detail view of an end of an arch element and a portion of a foundation block during one step in the process of erecting the arch system in accordance with the teaching of the present disclosure.

Figure 18:
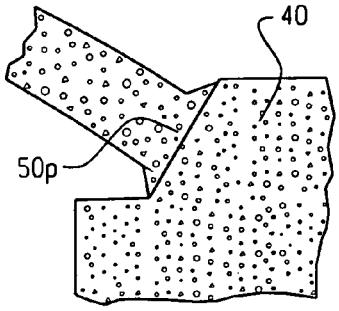

FIG. 18 shows a detail view of one form of an arch element and its footing that is included in the disclosure of the present invention.

Figure 19:
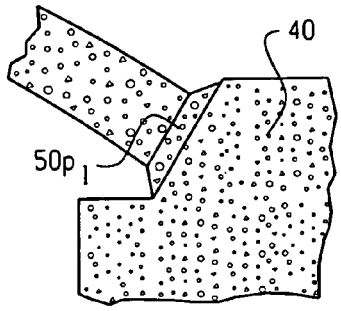

FIG. 19 shows another detail view of a form of an arch element and its footing that is included in the disclosure of the present invention.

Figure 20:
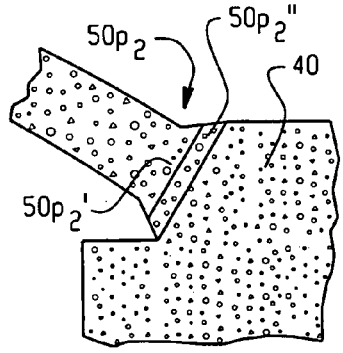

FIG. 20 shows another detail view of a form of the arch element and its footing that is included in the disclosure of the present invention.

DETAILED DESCRIPTION OF THE PREFERRED EMBODIMENT OF THE INVENTION

Other objects, features and advantages of the invention will become apparent from a consideration of the following detailed description and the accompanying drawings.

Figure 1:
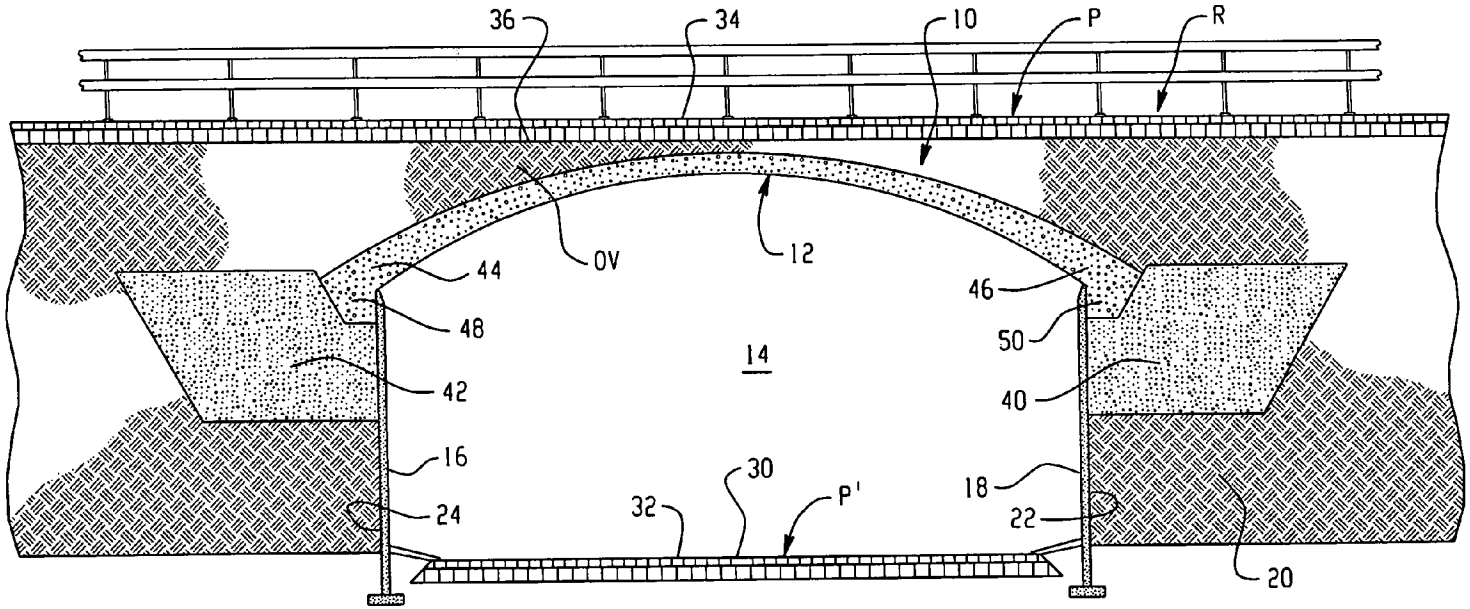

Shown in FIG. 1 is an arch support system such as disclosed in the incorporated document. Reference is made to the incorporated document of patent application Ser. No. 10/102,921 for a full disclosure of the system shown in FIG. 1. However, by way of reference, shown in FIG. 1 is a system 10 which includes an arch span 12, which also will be referred to as an arch element, or simply an arch, which forms the roof of a void or open space 14 within an earth filled space. Beneath arch span 12, walls 16 and 18, which will also be referred to as side walls or retaining walls, retain backfilled earth 20 or excavation edges 22 and 24 of previously existing (in situ) ground material on either side of void or open space 14 above arch space 12, overfill (earth) material OV is placed to create the plane 36. The arch and retaining walls may or may not be structurally connected. The art and practice of the present invention enables the arch and the walls to be constructed independently, in different construction phases. The purpose and form of the arch, the retaining walls and the means of founding these two key components of the backfilled and/or overfilled structure will be understood from the teaching of the incorporated disclosure.

Structure 10 can be located between first selected area 30 which can be the floor of a void or a lower pathway, and which includes a plane 32, and a second selected area 34 which can be a roof of a void or an upper pathway which includes a plane 36. Arch span 12 and overfill (earth) material OV is placed to create the plane 36.

The arch span is founded via arch footings 48 and 50 and foundation blocks 40 and 42 on general earth backfill 20 and/or on in situ soil (the surface of the previously existing (in situ) subsoil having been excavated to that extent). Foundation blocks 40 and 42 are each placed behind corresponding sidewalls 18 and 16 respectively of the overfilled and/or backfilled arch structure during its construction. Arch footings 48 and 50, formed of concrete and/or reinforced concrete are interposed between springs 44 and 46 which will also be referred to as ends of arch span 12 and the foundation blocks to distribute forces over a wide area thus also reducing the strength and stiffness requirements of the solidified fill material of the foundation blocks.

As discussed in the incorporated disclosure, the foundation blocks distribute the concentrated arch support forces at the springs of the arch via arch footings onto a sufficiently large earth backfill area such that the bearing pressure on the volume of (in situ or backfill) earth to which the arch loads are applied does not cause unacceptable displacements, especially in the horizontal direction.

As is also shown in FIG. 1, a roadway R can be located above the system and can include pavement P with pavement P' located beneath the system.

Figure 2B:
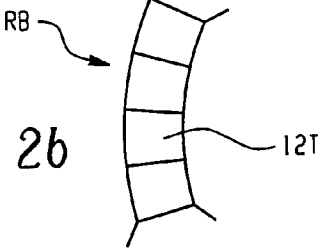
Figure 2C:
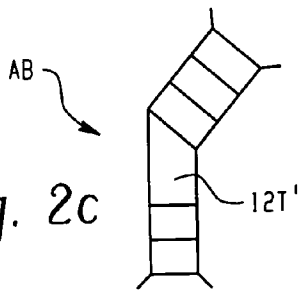
Figure 2A:
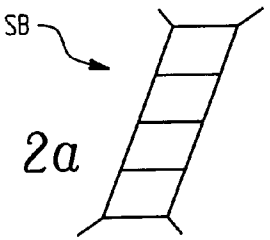

Shown in FIGS. 2*a*–2*c* are examples of the type of systems that can be formed using the teaching of the present disclosure. As shown in FIG. 2*a*, the system can include skew elements SB. As shown in plan view FIG. 2*b*, the system can include a round bridge RB having a plurality of trapezoidal arch elements 12T or an angled system AB with one trapezoidal element 12T'. Plan views of different arch structures are shown in FIGS. 3*a*, 3*b* and 3*c* as curved elements CB, skew elements SE and straight elements STE.

As discussed above, the method embodying the present invention forms the arch elements in a use orientation. The use orientation for arch element 12 is shown in FIG. 1; whereas, a side on orientation would have arch element 12 oriented at a 9.0° angle with respect to the orientation shown in FIG. 1. As also discussed above, forming the arch elements in the use orientation produces several advantages over forming the arch element in a side-on orientation. A formwork 60 is shown in FIG. 4 in plan view and can be used to form the straight elements STE, and/or the skew elements SE and/or the trapezoidal elements TE. The skew elements can include an angle α. Formwork 60 can include walls, such as 62, to define the desired shapes as well as outer perimeter walls 64. Materials and procedures suitable for forming the arch elements are carried out using the formwork and suitable procedures. The formwork is very simple and no counter forms are usually required. The formwork can be lifted up or down on one side of the form as indicated by double-headed arrow 66 in FIG. 5 to help in placing and vibrating the concrete in the formwork, and to prevent the flow of vibrated concrete by changing the gradient/slope. The lifting can be performed using a suitable jack. The formwork, itself, can be vibrated, and when using the lifting system with suitable jacks, the vibration of the formwork can be done in halves or thirds of the arch element.

Once the concrete is poured and has hardened, the elements are moved, in the use orientation, from the formwork to a yard for stacking and from there to a transportation vehicle using a crane or the like. As shown in FIGS. 6*a* and 6*b*, an element $\mathbf{12}_x$ is attached to a crane (not shown) by a harness 68 which includes two cables 70 and 72 attached to a first surface 74 of element $\mathbf{12}_x$. As element $\mathbf{12}_x$ is lifted from the formwork, it will flex under its own weight from an unflexed configuration $\mathbf{12}_{x1}$ as shown in solid line in FIG. 6*a* to a flexed configuration $\mathbf{12}_{x2}$ shown in dotted lines in FIG. 6*a*. This flexing can be used to obtain the desired pre-deformation to prestress the arch to partly or wholly compensate the influence of a possible outward yield (deformation) of the foundation blocks when the arch is subjected in its final position to loading. The arch elements are placed in their pre-deformed shape (indicated in dotted line in FIG. 6*a*) and return to their original shape (indicated in solid line in FIG. 6*b*) when overfilled. When the elements with the dotted line shape are placed onto the foundation blocks, the foundation blocks will hardly move under the dead weight of the arches only. When all elements have been placed, the overfill is placed which then has a total weight greater than that of the elements alone. This loading condition, the overfill plus the arch dead weight, produces a considerable horizontal thrust are on the foundation blocks. If the foundation block, or blocks, is/are not as stiff as desirable, this loading may push the foundation blocks out by a small amount. Even small movements result in the activation of the earth resistance to a considerable degree preventing further movement of the foundation block. Ideally, the foundation block will move out about as much as the ends of the arch elements have been drawn together by the pre-deformation before installation. If this is the case, the moments introduced by the drawing together of the ends and the opposite moments caused by the outward deformations of the foundation blocks will largely cancel each other out so that the elements—before traffic loads are applied—are in a state of very little moments. This helps to overcome disadvantages created by a certain amount of yielding of the foundation blocks. Should the foundation blocks not yield, the prestressing or pre-deformation is not harmful because it is done only to a degree which is within the allowable limits of the arch design. Furthermore, the moments generated by prestressing are opposite in direction to the majority of moments generated by traffic and are therefore not detrimental to the load carrying capacity of the arch.

Prestressing of the arch element can also be effected by structural elements, such as tie rod 80 shown for arch element $\mathbf{12}_{x2}$. Tie rod 80 can include a turnbuckle 82 or the like to set the desired amount of camber, or pre-deformation on the arch element.

As discussed above, in some instances differential displacement can occur between adjacent arch elements in a system having a plurality of arch elements. This differential deformation can be prevented, or at least minimized, by connecting adjacent arch elements together once they have been put in place. The connection can transfer shear forces between elements and thereby reduce the relative displacements to zero or almost zero. Additionally, the load carrying capacity is increased since two or more adjacent elements carry the imposed loads in unison.

The method embodying the present invention includes connecting adjacent elements in one of several different ways.

The first connection is via post-tensioning one or several of the tie elements. This can be effected by introducing tension braces to the tie elements. The post-tensioning force creates friction between the adjacent elements which in turn provides shear resistance. The shear resistance prevents and counteracts differential deformation between adjacent arch elements.

A second form of connection is by bolting. Bolting is indicated in FIGS. 8 through 13. Holes, such as hole 90 are provided through each arch element. The holes can be defined by placing pipes in the formwork during formation of the arch element. The holes can have a counterbore 92 on each end thereof. The holes in each arch element are located so that the holes in one arch element will be aligned with the holes in an adjacent arch element as shown in FIG. 10 for adjacent arch elements $\mathbf{12}_{xa1}$ and $\mathbf{12}_{xa2}$. A relatively thick steel rod or dowel bar 94 (reinforcement bar) is positioned in the aligned holes such that it extends through the holes in at least two adjacent arch elements. To ensure centricity of the rod, support elements 96 can be located in the arch elements inside the holes. To guarantee a tight fit and proper load transfer, the rod has a sheath 98 surrounding it which can be a thin but tough plastic sheathing. After placement of the rod the sheath is filled with grout (cement plus the sand (or filler) plus water) under pressure. The grout fills the interspace between the rod and the arch element adjacent to the holes. The grout prevents play between the rod and the arch element. The rod or dowel bar becomes, after hardening of the grout, an integral part of the arch element. A space 99 exists between the sheath and the arch element adjacent to the hole and is filled when the sheath expands after insertion of grout under pressure. At ring joints, such as ring joint RJ (see FIGS. 3*a* to 3*c*), the bar or rod continues between elements. Here also it is surrounded by grout which protects it against corrosion. Since the sheath extends for the entire length of the rod or dowel bar, the grout will not leak out of the sheath before setting. The sheath will expand to snugly fit the hole (or holes). At the joints between the elements, such as joint 102, the sheath prevents the grout from leaking out. Additionally, as shown in FIG. 13, caulking 104 can be applied at the joints to make the structure watertight.

It is also noted that in order to produce a bridge from precast elements, it has to be done in several pieces which are each smaller than the entire bridge. These pieces (elements) can be tied together on site using the dowel and grouting system discussed above.

It is also noted that due to the rods or dowels the precast arch bridge performs almost as well, deformation and resistancewise, as if the joint (the ring joint) didn't exist as would be the case with a cast-in-place structure. The whole bridge acts as a homogeneous vault and not a number of individual arch elements, one next to the other. Thus, the rods or dowel bars are an effective means to overcome the drawbacks of precast structures which are separated by joints instead of being homogeneous structures like cast-in-place structures.

Still further means can be used to connect adjacent arch elements. Such a further means is indicated in FIG. 14 and includes a cam 110 in one arch element and a corresponding depression 112 in an adjacent arch element. Each arch element contains both cams and depressions. A cam on one elements is accommodated in an associated depression on an adjacent element to connect the two adjacent elements together. Adhesive can also be applied to the cam and/or to the depression to provide a permanent connection free of play.

The foundation of the precast arch element is, in principal, the same as the foundation disclosed in the incorporated document. The foundation will include the foundation block. The arch elements can include an arch footing such as indicated in FIG. 1 as arch footings 48 and 50. In the means and method embodying the present invention, the arch footings can be precast together with the arch element as indicated for arch footing $\mathbf{50}_p$ in FIG. 18 which rests directly on the foundation block. Another form of the arch footing is shown in FIG. 19 as arch footing $\mathbf{50}_{p1}$ which is cast in place and connected to the arch element which does not contain precast footings. Yet another form of the arch footing is shown in FIG. 20 as arch footing $\mathbf{50}_{p2}$. Arch footing $\mathbf{50}_{p2}$ includes a small footing $\mathbf{50}_{p2'}$ that is precast with the arch element and a layer of cast-in-place concrete $\mathbf{50}_{p2''}$ between the precast footing and the foundation block. This procedure allows the precast footing to be designed quite small (thus adding only little weight to the precast element) while the concrete (preferably unreinforced) which is cast-in-place between the precast element and the foundation block spreads the footing forces sufficiently to be borne by the solidified earth material of the foundation block. This cast-in-place concrete would be poured after the precast elements are installed in their final position, the latter being provisionally supported on locally protruding parts of the arch element LPP in FIGS. 3*a* to 3*c* or element 124 of FIG. 16. This ensures that the final support will be between the larger part of the arch element and the foundation block via the cast-in-place concrete.

This process of placing cast-in-place concrete between the arch element and the foundation block is indicated in FIGS. 15 to 17 in which arch element 120 has an end area 122. An element 124 extends out of the end area of the arch element and engages the foundation block when the arch element is initially installed. Reinforced or unreinforced concrete 126 is then cast in place around the arch element end and the foundation block and overfill 128 is subsequently placed on the cast-in-place concrete once this has hardened. Concrete can also be located between the end of the arch element and the foundation block as indicated in FIG. 15 by cast-in-place concrete 130.

As used herein, the term "prestressing" refers to the condition of an arch element such as shown in FIGS. 6*a* and 7 prior to placement of the arch element in the system; and the term "post-tensioning" refers to a condition of an arch element after it has been placed. Thus, the elements shown in FIGS. 6*a* and 7 are prestressed; whereas, adjacent arch elements 12 can be post-tensioned by the action of the dowel rods or by the action of friction of one arch element on an adjacent arch element or by the interlocking action of the elements shown in FIG. 14.

It is understood that while certain forms of the present invention have been illustrated and described herein, it is not to be limited to the specific forms or arrangements of parts described and shown.

What is claimed is:

1. An arch support system comprising:

A) a first selected area having side edges;

B) a second selected area spaced above said first selected area and extending beyond a vertical projection of side edges of said first selected area;

C) an arch structure located between said first selected area and said second selected area;

D) said arch structure including a sidewall adjacent to each side edge of said first selected area, and a precast arch element spanning said first selected area, said precast arch element being located beneath said second selected area;

E) each of the sidewalls of said arch structure having a bottom end located adjacent to said first selected area and a top end spaced above said first selected area;

F) said precast arch element of said arch structure having an end positioned adjacent to an upper end of each sidewall of said arch structure;

G) a foundation block positioned near and behind each sidewall of said arch structure, each foundation block supporting one of the ends of the arch element of said arch structure, said foundation block comprising soil; and H) an arch footing associated with said precast arch element.

2. The arch support system defined in claim 1 wherein said arch footing is unitary and monolithic with said precast arch element.

3. An arch support system comprising:

A) a first selected area having side edges;

B) a second selected area spaced above said first selected area and extending beyond a vertical projection of side edges of said first selected area;

C) an arch structure located between said first selected area and said second selected area;

D) said arch structure including a sidewall adjacent to each side edge of said first selected area, and a plurality of precast arch elements spanning said first selected area and being located adjacent to each other and located beneath said second selected area;

E) each of the sidewalls of said arch structure having a bottom end located adjacent to said first selected area and a top end spaced above said first selected area;

F) said precast arch element of said arch structure having an end positioned adjacent to an upper end of each sidewall of said arch structure;

G) a foundation block positioned near and behind each sidewall of said arch structure, each foundation block supporting one of the ends of the arch element or said arch structure, said foundation block comprising soil; and H) arch footings associated with each of said precast arch elements.

4. The arch support system defined in claim 3 further including a tie element connecting adjacent arch elements together.

5. The arch support system defined in claim 4 wherein said tie element includes a sheath.

6. The arch support system defined in claim 5 wherein said tie element further includes grout located in said sheath.

7. The arch support system defined in claim 4 wherein said tie element includes a dowel rod.

8. The arch support system defined in claim 4 wherein said tie element further includes a tie rod.

9. The arch support system defined in claim 4 further including a hole defined in each arch element.

10. The arch support system defied in claim 9 further including a spacer element in said hole defined in each arch element.

11. An arch support system comprising:

A) a first selected area having side edges;

B) a second selected area spaced above said first selected area and extending beyond a vertical projection of the side edges of said first selected area;

C) an arch structure located between said second selected area and said first selected area;

D) said arch structure including a sidewall adjacent to each side edge of said first selected area, and a prestressed precast arch element spanning said first selected area, said prestressed precast arch element being located beneath said second selected area;

E) each of the sidewalls of said arch structure having a bottom end located adjacent to said first selected area and a top end spaced above said first selected area;

F) said prestressed precast arch element of said arch structure having an end positioned adjacent to an upper end of each sidewall of said arch structure; and G) a foundation block positioned near and behind each sidewall of said arch structure, each foundation block supporting one of the ends of the arch element of said arch structure, said foundation block comprising soil.

12. The arch support system defined in claim 1 wherein said arch element is prestressed.

13. The arch support system defined in claim 8 wherein said tie rod is post-tensioned.

14. The arch support system defined in claim 3 wherein said arch elements are prestressed.

15. An arch system comprising:

A) soil material;

B) a void area in said soil material, the void area having first and second sidewalls and a lower pathway therebetween;

C) a first precast arch element spanning said void area and having first and second ends, each end positioned toward a respective one of the first and second sidewalls of the void area, the first precast arch element includes first and second spaced apart sides extending between the first and second ends, the first precast arch element including at least one side-to-side opening extending through the precast arch element from the first side to the second side;

D) a second precast arch element spanning said void area and having first and second ends, each end positioned toward a respective one of the first and second sidewalls of the void area, the second precast arch element includes first and second spaced apart sides extending between the first and second ends of the second precast arch element, the second precast arch element including at least one side-to-side opening therethrough, wherein said first precast arch element and said second precast arch element are located side-by-side to align the side-to-side opening of the first precast arch element with the side-to-side opening of the second precast arch element;

E) a tie element extending through the aligned side-to-side openings of said first and second precast arch elements to connect said first and second precast arch elements together; and F) overfill material atop the first and second precast arch elements.

16. The arch system defined in claim 15 wherein said tie element includes a sheath.

17. The arch system defined in claim 16 wherein said tie element further includes grout located in said sheath.

18. The arch system defined in claim 15 wherein said tie element includes a dowel rod.

19. The arch system defined in claim 15 wherein the side-to-side opening of the first precast arch element includes a spacer therein and the side-to-side opening of the second precast arch element includes a spacer therein.

20. The arch system defined in claim 15 wherein the side-to-side opening of the first precast arch element includes enlarged end bores and the side-to-side opening of the second precast arch element includes enlarged end bores.

21. The arch system defined in claim 15 wherein the first precast arch element includes multiple side-to-side openings aligned with a corresponding multiple of side-to-side openings of the second precast arch element, and a corresponding multiplicity of tie elements.

22. The arch system of claim 15 further including:

first and second spaced apart sidewalls along respective sides of said void area;

a first foundation block behind the first sidewall and a second foundation block behind the second sidewall;

the first end of the first precast arch element abuts the first foundation block and the first end of the second precast arch element abuts the first foundation block;

the second end of the first precast arch element abuts the second foundation block and the second end of the second precast arch element abuts the second foundation block.

23. An arch system comprising:

A) soil material;

B) a void area in said soil material, the void area having a first sidewall, a second sidewall, and a lower pathway therebetween;

C) a first precast arch element spanning said void area and having a first and positioned toward the first sidewall, a second, opposite end positioned toward the second sidewall, and first and second spaced apart side edges extending between the first and second ends, at least one cam located along the first side edge of said first precast arch element;

D) a second precast arch element spanning said void area and having a first end positioned toward the first sidewall, a second, opposite end positioned toward the second sidewall, and first and second spaced apart side edges extending between the first and second ends of the second precast arch element, at least one depression located along the second side edge of said second precast arch element, wherein said second precast arch element is located with its second side edge in abutment with the first side edge of said first precast arch element to locate the cam of said first precast arch element in the depression of said second precast arch element;

E) overfill material atop the first and second precast arch elements.

24. The arch system of claim 23, further including adhesive between the cam and the depression.

25. The arch system of claim 23 wherein the first side edge or said first precast arch element includes a series of spaced apart cams and the second side edge of said second precast arch element includes a corresponding series of spaced apart depressions.

26. The arch system of claim 25 wherein the first precast arch element and the second precast arch element are substantially identical in shape and size.

27. The arch system of claim 23 further including:

first and second spaced apart sidewalls along respective sides of said void area;

a first foundation block behind the first sidewall and a second foundation block behind the second sidewall;

a first end of the first precast arch element abuts the first foundation block and a first end of the second precast arch element abuts the first foundation block;

a second end of the first precast arch element abuts the second foundation block and a second end of the second precast arch element abuts the second foundation block.

* * * * *

UNITED STATES PATENT AND TRADEMARK OFFICE

CERTIFICATE OF CORRECTION

PATENT NO. : 6,988,337 B1
DATED : January 24, 2006
INVENTOR(S) : Werner Heierli

It is certified that error appears in the above-identified patent and that said Letters Patent is hereby corrected as shown below:

Column 10,
Line 65, change "or" to -- of --.

Column 11,
Line 16, change "defied" to -- defined --.

Column 12,
Line 52, change "and" to -- end --.

Column 13,
Line 9, change "or" to -- of --.

Signed and Sealed this

Fourth Day of April, 2006

JON W. DUDAS
*Director of the United States Patent and Trademark Office*